US005379799A

United States Patent [19]

Kawai et al.

[11] Patent Number: 5,379,799

[45] Date of Patent: Jan. 10, 1995

[54] DISCHARGE VALVE APPARATUS FOR COMPRESSOR

[75] Inventors: Katsunori Kawai; Ryo Kato; Akio Saiki; Yuji Kaneshige, all of Kariya, Japan

[73] Assignee: Kabushiki Kaisha Toyoda Jidoshokki Seisakusho, Kariya, Japan

[21] Appl. No.: 141,901

[22] Filed: Oct. 22, 1993

Related U.S. Application Data

[63] Continuation of Ser. No. 926,466, Aug. 7, 1992, abandoned.

[30] Foreign Application Priority Data

Aug. 13, 1991 [JP] Japan ..... 3-202774

[51] Int. Cl.[6] ..... F16K 15/14

[52] U.S. Cl. ..... 137/856

[58] Field of Search ..... 137/856

[56] References Cited

U.S. PATENT DOCUMENTS

| | | | |
|---|---|---|---|
| 1,669,889 | 5/1928 | Andrews | 137/856 |
| 2,118,356 | 5/1938 | Money | 137/856 |
| 2,151,746 | 3/1939 | Cody . | |
| 2,848,157 | 8/1958 | Ayling . | |
| 3,998,243 | 12/1976 | Osterkorn | 137/856 |
| 4,714,416 | 12/1987 | Sano | 137/856 X |
| 4,955,797 | 9/1990 | Cowen | 137/856 X |

FOREIGN PATENT DOCUMENTS

| | | | |
|---|---|---|---|
| 120958 | 3/1944 | Australia | 137/856 |
| 2290132 | 5/1976 | France . | |
| 3050423 | 4/1984 | Germany . | |
| 3909343 | 9/1990 | Germany . | |
| 290240 | 5/1991 | Germany . | |
| 62-131985 | 6/1987 | Japan . | |
| 2091851 | 8/1982 | United Kingdom . | |

*Primary Examiner*—Robert G. Nilson
*Attorney, Agent, or Firm*—Brooks Haidt Haffner & Delahunty

[57] ABSTRACT

A discharge valve apparatus for a compressor includes a valve plate with a port opened, a lead valve fixed on the valve plate, adapted for swingably opening and closing the port elastically, and including a substantially disk-shaped head portion and a neck portion constricted continuously from the head portion, and a retainer fixed on the valve plate, and including an inclining surface adapted for regulating the opening degree of the lead valve, the inclining surface having an inclination varying around an area where the retainer is brought into contact with the head portion of the lead valve when the lead valve fully opens the port. With the discharge valve apparatus, the lead valve can be inhibited from adhering on the retainer through the lubricant contained in the refrigerant, and accordingly the volumetric efficiency deterioration, resulting from the retardation of the lead valve in the returning, can be inhibited. In addition, instead of the inclining surface of the retainer, the discharge valve apparatus may include a contact projection disposed either on a surface of the retainer facing the lead valve or on a surface of the lead valve facing the retainer.

5 Claims, 7 Drawing Sheets

DISCHARGE VALVE APPARATUS FOR COMPRESSOR

This application is a continuation of application Ser. No. 07/926,466 filed Aug. 7, 1992, now abandoned.

BACKGROUND OF THE INVENTION

1. Field of the Invention

The present invention relates to a discharge valve apparatus for a compressor. The present discharge valve apparatus is suitable for a compressor for air-conditioning a vehicle, and it is especially suitable for a reciprocative type compressor therefor.

2. Description of the Related Art

As described in Japanese Unexamined Patent Publication (Kokai) No. 131985/1987, a reed valve type valve apparatus has been used as a valve apparatus for a reciprocative type compressor conventionally. For example, there has been known a reed valve type valve apparatus as illustrated in FIG. 17. In a discharge valve of the valve apparatus, there are provided a bore 100 in which a refrigerant is compressed, a discharge chamber 103, a valve plate 105 with a port 106 formed, a plate-spring-like reed valve 107, and a retainer 109. The lead valve 107 is assembled on the valve plate 105 together with the retainer 109.

In the conventional reed valve type valve apparatus, it is usually put into a closed state. When the differential pressures between the bore 100 and the discharge chamber 103 increase to a valve opening pressure or more, the reed valve 107 is designed so that it is separated from the valve plate 105 so as to open the port 106 and thereby the valve apparatus is opened. When the valve apparatus is opened, the refrigerant which has been compressed in the bore 100 is transferred through the port 106, and it is discharged into the discharge chamber 103. Here, the opening degree of the reed valve 107 is regulated by the retainer 109.

In the above-described conventional reed valve type valve apparatus, the reed valve 107 is adhered to the retainer 109 so closely that it hardly comes off the retainer 109 because of a lubricant oil contained in the refrigerant. As a result, when the discharge operation is turned into the suction operation, a discharge gas is flowed back in the reverse direction by the retardation of the reed valve 107 in the returning, thereby deteriorating the volumetric efficiency of the compressor.

SUMMARY OF THE INVENTION

It is an object of the present invention to provide a discharge valve apparatus for a compressor which inhibits the deterioration of the volumetric efficiency of the compressor satisfactorily. Here, the deterioration of the volumetric efficiency results from the retardation of the discharge reed valve in the returning.

A discharge valve apparatus for a compressor according to the present invention comprises:

- a valve plate with a port opened;
- a reed valve fixed on the valve plate, adapted for swingably opening and closing the port elastically, and including a substantially disk-shaped head portion and a neck portion constricted continuously from the head portion; and
- a retainer fixed on the valve plate, and including an inclining surface adapted for regulating the opening degree of the reed valve, the inclining surface having an inclination varying around an area where the retainer is brought into contact with the head portion of the reed valve when the lead valve fully opens the port.

In the present discharge valve apparatus, the inclining surface is not necessarily a flat surface. The inclining surface may be constructed with a curved surface portion, or it may be constructed with a combination of a flat surface portion and a curved surface portion.

In addition, a discharge valve apparatus for a compressor according to the present invention comprises:

- a valve plate with a port opened;
- a reed valve fixed on the valve plate, adapted for swingably opening and closing the port elastically;
- a retainer fixed on the valve plate; and
- a contact projection disposed either on a surface of the retainer facing the reed valve or on a surface of the lead valve facing the retainer.

In this second form of the present discharge valve apparatus, the lead valve may be constructed so that it includes a substantially disk-shaped head portion and a neck portion constricted continuously from the head portion.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
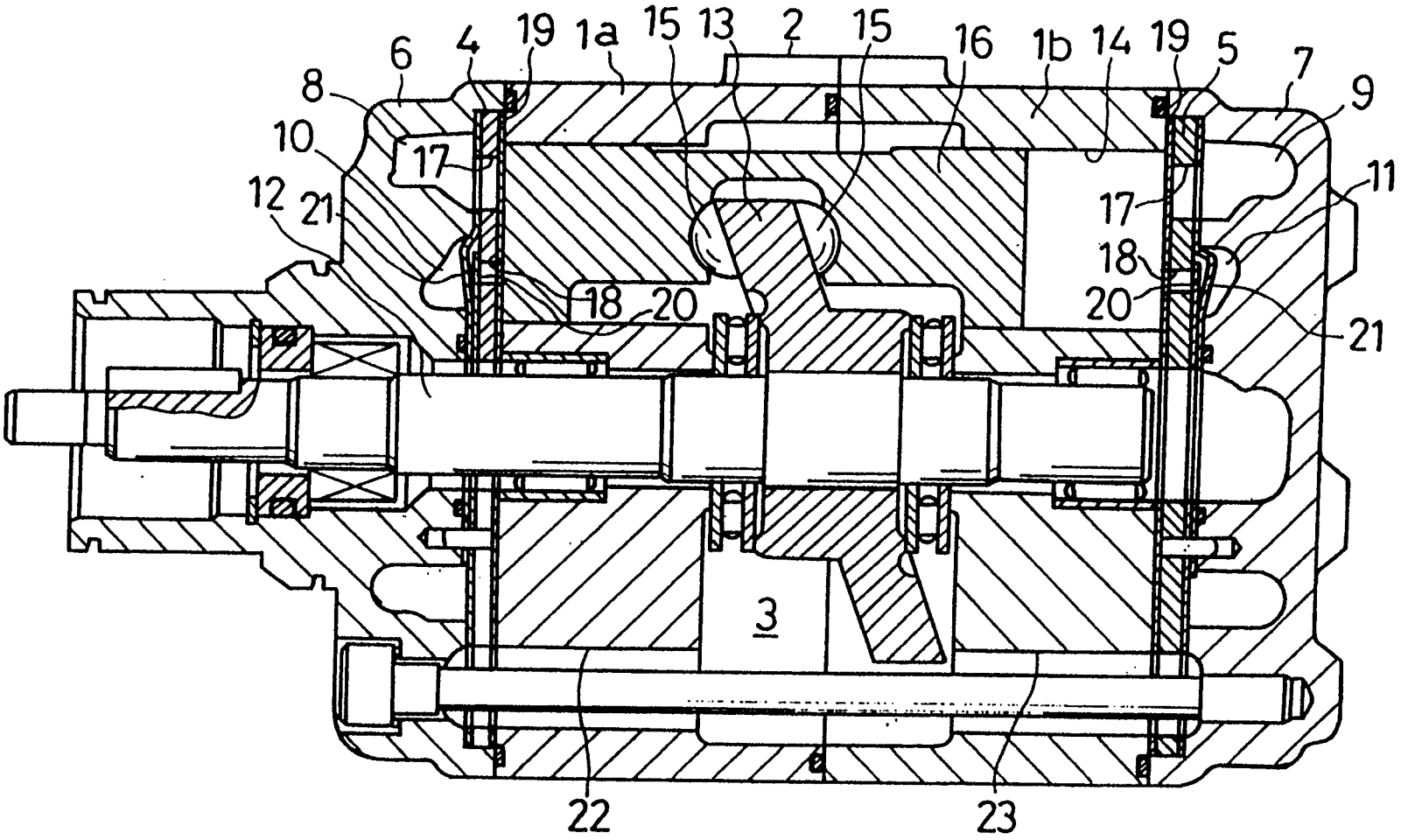
FIG. 1 is a vertical cross sectional view of a swash plate type compressor in which a discharge valve apparatus of a First Preferred Embodiment according to the present invention is incorporated.

As having been described previously, in the first form of discharge valve apparatus according to the present invention, the reed valve is swung by a discharge pressure so as to open the port, and it is brought into contact with the inclining surface of the retainer during the discharge operation.

In the first form of discharge valve apparatus according to the present invention, the inclination of the inclining surface is varied around an area where the retainer is brought into contact with the head portion of the reed valve when the lead valve fully opens the port. Because the head portion of the reed valve has a large flexural rigidity, it cannot follow the inclining surface of the retainer whose inclination is varied, and accordingly there arises a clearance between the head portion of the reed valve and the inclining surface of the retainer when the reed valve is brought into contact with the retainer. Therefore, the contacting area between the reed valve and the retainer is reduced by the clearance, and accordingly the reed valve is more likely to come off the retainer.

Further, even if the head portion of the reed valve has a small flexural rigidity, or even if the inclination of the inclining surface is varied slightly, the head portion may undergo an elastic deformation so that it follows the inclining surface whose inclination is varied, and so that it may be adhered to the inclining surface of the retainer without forming the clearance. However, if such is the case, the reed valve is still likely to come off the retainer because it exhibits a large elastic recovery force which results from the head portion having the large flexural rigidity and undergoing the large elastic deformation.

Moreover, in the second form of the discharge valve apparatus according to the present invention, the reed valve is brought into contact with the retainer by way of the contact projection which is disposed either on the retainer surface or on the reed valve surface. Hence, there also arises a clearance between the reed valve and the retainer. Therefore, the contacting area between the reed valve and the retainer is reduced, and accordingly the reed valve is more likely to come off the retainer.

As having been described so far, in the discharge valve apparatus for a compressor according to the present invention, the reed valve can be effectively inhibited from adhering on the retainer through the lubricant contained in the refrigerant and from being less likely to come off the retainer. Hence, with the discharge valve apparatus according to the present invention, it is possible to successfully inhibit the volumetric efficiency deterioration which results from the retardation of the reed valve in the returning.

Having generally described the present invention, a further understanding can be obtained by reference to the specific preferred embodiments which are provided herein for purposes of illustration only and are not intended to limit the scope of the appended claims.

First Preferred Embodiment

The discharge valve apparatus of the First Preferred Embodiment according to the present invention will be hereinafter described with reference to FIGS. 1 through 4. The discharge valve apparatus is incorporated in a swash plate type compressor.

As illustrated in FIG. 1, in the swash plate type compressor, a pair of cylinder blocks 1*a* and 1*b* is disposed oppositely at the front and rear, and accordingly a swash plate chamber 3 is formed at the connection between the cylinder blocks 1*a* and 1*b*. The swash plate chamber 3 is communicated with a return refrigerant suction port 2. At a front end of the cylinder block 1*a* and at a rear end of the cylinder block 1*b*, the cylinder blocks 1*a* and 1*b* are enclosed with a front housing 6 and a rear housing 7 by way of valve plates 4 and 5, respectively. In the front housing 6 and the rear housing 7, there are formed suction chambers 8 and 9 on their radially outer side, and there are further formed discharge chambers 10 and 11 on their radially inner side. The suction chambers 8 and 9 are communicated with the swash plate chamber 3 through suction passages 22 and 23. The front discharge chamber 10 is communicated with the rear discharge chamber 11 through a discharge passage (not shown), and the rear discharge chamber 11 is communicated with a discharge port (not shown).

A driving shaft 12 is inserted into a common central axial bore formed between the cylinder blocks 1*a* and 1*b*, and it is engaged with the cylinder blocks 1*a* and 1*b* by way of radial bearings. Further, the driving shaft 12 is disposed so as to penetrate through the front valve plate 4, and it is supported detachably by the front housing 6. Furthermore, the driving shaft 12 is provided with a swash plate 13. The swash plate 13 is fixed around the driving shaft 12 so as to be rotatable in the swash plate chamber 3, and it is supported detachably by the cylinder blocks 1*a* and 1*b* by way of thrust bearings. Moreover, there are formed a plural pair of bores 14 and 14 at the front and rear in the cylinder blocks 1*a* and 1*b*. The bores 14 are disposed in parallel around the driving shaft 12. Double-headed pistons 16 are inserted into and engaged with the bores 14 reciprocatively, and they are anchored at the periphery of the swash plate 13 by way of a pair of shoes 15 and 15.

Figure 3:
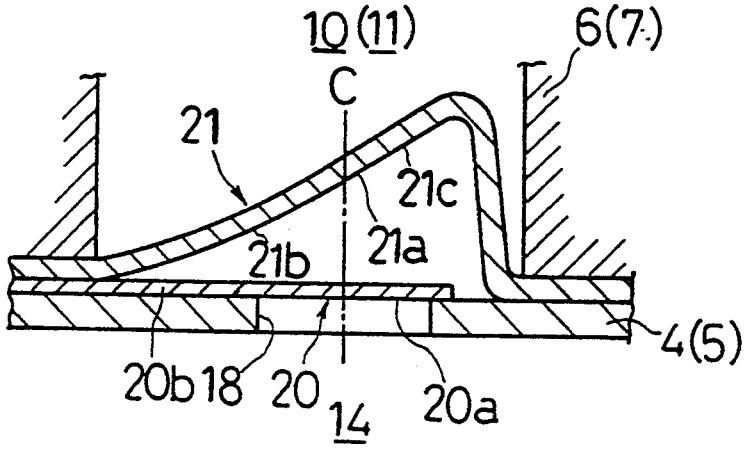
FIG. 3 is a fragmentary cross sectional view of the discharge valve apparatus of the First Preferred Embodiment.

In the front valve plate 4, there are formed a suction port 17 and a discharge port 18. The suction port 17 communicates the front suction chamber 8 with the bore 14, and the discharge port 18 communicates the front discharge chamber 10 with the bore 14. Further, a suction reed valve 19 is disposed on the front valve plate 4 on the front cylinder block 1*a* side, and it is assembled thereto so as to open and close the suction port 17 elastically and swingably. Furthermore, a discharge reed valve 20 is disposed on the front valve plate 4 on the front housing 6 side, it is assembled thereto together with a retainer 21 so as to open and close the discharge port 18 elastically and swingably. Moreover, as illustrated in FIG. 3, the opening degree of the discharge reed valve 20 is regulated by an inclining surface 21*a* of the retainer 21 which is assembled to the front valve plate 4 together with the discharge reed valve 20. The inclining surface 21*a* of the retainer 21 is disposed so as to incline by a predetermined angle with respect to the front valve plate 4. On the other hand, the opening degree of the suction reed valve 19 is regulated by a cut-off groove (not shown) which is carved adjacent to an opening of the bore 14 at the end of the front cylinder block 1*a*.

Likewise, in the rear valve plate 5, there are formed a suction port 17 and a discharge port 18. The suction port 17 communicates the rear suction chamber 9 with the bore 14, and the discharge port 18 communicates the rear discharge chamber 11 with the bore 14. Further, a suction reed valve 19 is disposed on the rear valve plate 5 on the rear cylinder block 1*b* side, and it is assembled thereto so as to open and close the suction port 17 elastically and swingably. Furthermore, a discharge reed valve 20 is disposed on the rear valve plate 5 on the rear housing 7 side, it is assembled thereto together with a retainer 21 so as to open and close the discharge port 18 elastically and swingably. Moreover, as can be understood from FIG. 3, the opening degree of the discharge reed valve 20 is regulated by an inclining surface 21*a* of the retainer 21 which is assembled to the rear valve plate 5 together with the discharge reed valve 20. The inclining surface 21*a* of the retainer 21 is disposed so as to incline by a predetermined angle with respect to the rear valve plate 5. On the other hand, the opening degree of the suction reed valve 19 is regulated by a cut-off groove (not shown) which is carved adjacent to an opening of the bore 14 at the end of the rear cylinder block 1*b*.

Thus, the constructions around the front and the rear valve plates 4 and 5 are identical with each other substantially. Accordingly, only the construction around the front valve plate 4 will be hereinafter described in detail.

Figure 2:
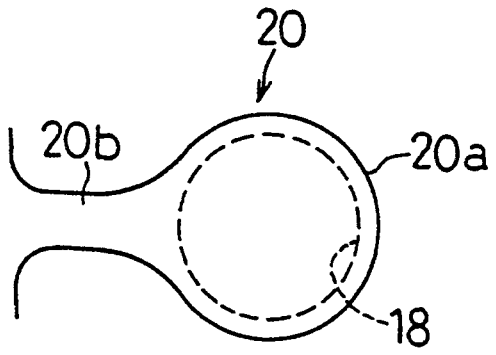
FIG. 2 is a plan view for illustrating a configuration of a discharge reed valve of the discharge valve apparatus of the First Preferred Embodiment.

As illustrated in FIG. 2, the discharge reed valve 20 includes a substantially disk-shaped head portion 20*a* which has a large flexural rigidity, and a neck portion 20*b* which has a small flexural rigidity and which is constricted continuously from the head portion 20*a*. The discharge reed valve 20 opens and closes the discharge port 18 with the head portion 20*a*.

As illustrated in FIG. 3, the inclining surface 21*a* of the retainer 21 includes two portions, i.e., a curved surface portion 21*b* on the left-hand side in FIG. 3 with respect to the center line "C" of the discharge port 18, and a flat surface portion 21*c* on the right-hand side in FIG. 3 with respect thereto. That is to say, the curved surface portion 21*b* faces a portion of the discharge reed valve 20, portion which extends from a substantial center of the head portion 20*a* to the neck portion 20*b*. An inclination of the inclining surface 21*a* is varied around an area where the retainer 21 is brought into contact with the head portion 20*a* of the discharge reed valve 20 when the discharge reed valve 20 fully opens the port 18.

Also in the swash plate type compressor equipped with the thus constructed discharge valve apparatus of First Preferred Embodiment, a return refrigerant is introduced into the swash plate chamber 3 from a refrigerant circuit (not shown) by way of the suction port 2. The return refrigerant is further introduced into the suction chambers 8 and 9 through the suction passages 22 and 23. As a result, the rotation of the driving shaft 12 moves the pistons 16 reciprocatively in the bores 14 by way of the swash plate 13.

In the meantime, the suction reed valves 19 are separated from the valve plates 4 and 5 so as to open the suction ports 17 by the pressure decrements in the bores 14, and accordingly the return refrigerant in the suction chambers 8 and 9 is sucked through the suction ports 17 into the bores 14 whose volumes are increasing. At the same time, the discharge reed valves 20 are seated on peripheries of the discharge ports 18 in the valve plates 4 and 5 so as to close the communication between the bores 14 and the discharge chambers 10 and 11 by the pressure decrements in the bores 14 and by the high pressures in the discharge chambers 10 and 11. Thereafter, the pressures in the bores 14 increase so as to open the discharge reed valves 20 assembled to the valve plates 4 and 5 because of the reciprocative movement of the pistons 16, and accordingly the compressed refrigerant in the bores 14 whose volumes are decreasing is discharged through the discharge ports 18 to the discharge chambers 10 and 11. At the same time, the suction reed valves 19 are seated on peripheries of the discharge ports 17 so as to close the communication between the bores 14 and the suction chambers 8 and 9 by the pressure increments in the bores 14 and by the low pressures in the discharge chambers 8 and 9.

Thus, in the compressed refrigerant in the front discharge chamber 10 is collected in the discharge port 11 via a discharge passage (not shown), and the compressed refrigerant in the rear discharge chamber 11 is circulated again to the refrigerating circuit through a discharge port (not shown).

In the discharge valve apparatus of the First Preferred Embodiment, the retainer 21 includes the curved surface portion 21*b* which faces the portion of the discharge reed valve 20 extending from the substantial center of the head portion 20*a* to the neck portion 2O*b*. The discharge reed valve 20 includes the neck portion 20*b* which has the small flexural rigidity and the head portion 20*a* which has the large flexural rigidity.

Figure 4:
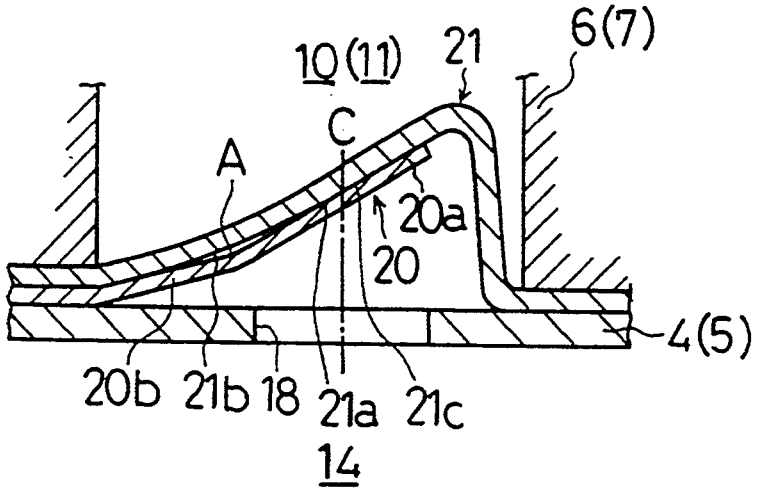
FIG. 4 is a fragmentary cross sectional view for illustrating an operation of the discharge valve of the First Preferred Embodiment in which the discharge reed valve is brought into contact with a retainer.

Thus, in the discharge operation, the discharge reed valve 20 is brought into contact with the inclining surface 21*b* of the retainer 21, during which the neck portion 20*b* is deformed greatly elastically but the head portion 20*a* is hardly deformed elastically or it is deformed slightly so that its flat surface is maintained. In the meantime, as illustrated in FIG. 4, the flat surface portion 21*c* of the retainer 21 is adhered to the portion of the discharge reed valve 20 which extends from the substantially center of the head portion 20*a* to the free end thereof, and accordingly there arises a clearance "A" between the curved surface portion 21*b* of the retainer 21 and the portion of the discharge reed valve 20 which extends from the substantially center of the head portion 20*a* to the neck portion 21*b*. Therefore, the contacting area between the discharge reed valve 20 and the retainer 21 is reduced by the existence of the clearance "A." Even if the head portion 20*a* having the large flexural rigidity is deformed elastically, a large elastic recovery force arises and acts on the head portion 20*a*. As a result, the discharge reed valve 20 can be inhibited effectively from adhering on the retainer 21 through the lubricant contained in the refrigerant.

Thus, in accordance with the discharge valve apparatus of the First Preferred Embodiment, the volumetric efficiency deterioration, resulting from the retardation of the discharge reed valve 20 in the returning, can be inhibited effectively. In addition, even if a larger discharge pressure acts on the reed valve 20, the entire surface of the head portion 20*a* is deformed elastically considerably so as to follow the curved surface portion 21*b* of the retainer 21, and the discharge reed valve 20 is adhered to the retainer 21 without forming the clearance "A," a much larger elastic recovery force arises and acts on the head portion 20*a* so that the discharge reed valve 20 can be promptly separated from the retainer 21.

Second Preferred Embodiment

Figure 5:
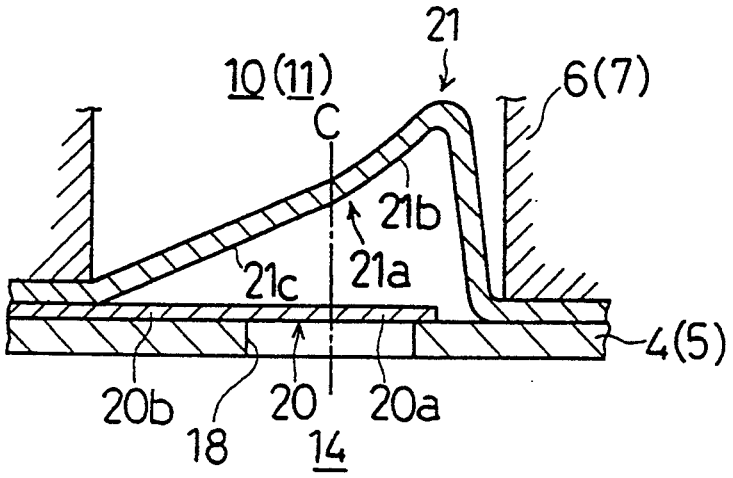
FIG. 5 is a fragmentary cross sectional view of a discharge valve apparatus of a Second Preferred Embodiment according to the present invention.
Figure 6:
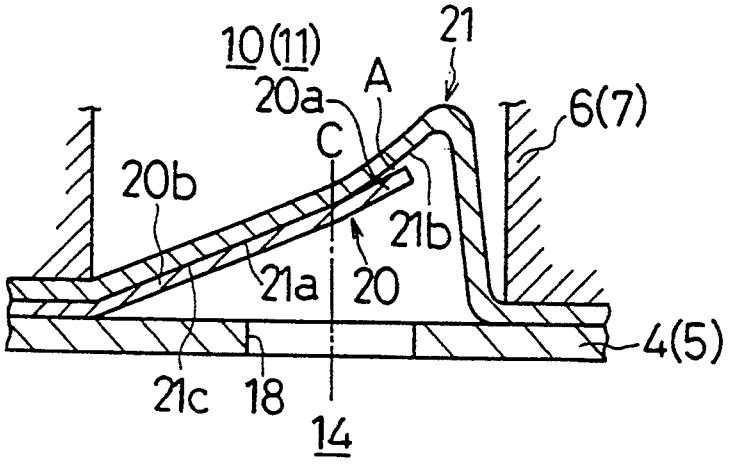
FIG. 6 is a fragmentary cross sectional view for illustrating an operation of the discharge valve apparatus of the Second Preferred Embodiment in which a discharge reed valve is brought into contact with a retainer.

As illustrated in FIGS. 5 and 6, the discharge valve apparatus of the Second Preferred Embodiment includes a retainer 21, and the retainer 21 includes a curved surface portion 21*b* and a flat surface portion 21*c* which are disposed in a positional relationship opposite to that of the discharge valve apparatus of the First Preferred Embodiment. Namely, in the discharge valve apparatus of the Second Preferred Embodiment, the retainer 21 includes the curved surface portion 21*b* on the right-hand side in FIG. 5 with respect to the center line "C" of a discharge port 18, and the flat surface portion 21*c* on the left-side in FIG. 5 with respect thereto. Specifically speaking, the curved surface portion 21*b* faces a portion of a discharge reed valve 20, portion which extends from a substantial center of a head portion 20*a* of the discharge reed valve 20 to a free end thereof.

Thus, in the discharge operation, the discharge reed valve 20 of the discharge valve apparatus of the Second Preferred Embodiment operates as follows: The neck portion 20*b* having a small flexural rigidity is deformed elastically greatly by the discharge pressure, and the head portion 20*a* having a large flexure rigidity is hardly deformed but the free end of the head portion 20*a* is deformed slightly by the discharge pressure. Accordingly, as illustrated in FIG. 6, the flat surface portion 21*c* of the retainer 21 is adhered to the portion of the discharge reed valve 20 extending from the substantial center of the head portion 20*a* to the neck portion 2O*b*, and there arises a clearance "A" between the curved surface portion 21*b* of the retainer 21 and the portion of the discharge reed valve 20 extending from the substantial center of head portion 20*a* to the free end. Therefore, the contacting area between the discharge reed valve 20 and the retainer 21 is reduced in a manner similar to that of the discharge valve apparatus of the First Preferred Embodiment. Even if the head portion 20*a* having the large flexural rigidity is deformed elastically, a large elastic recovery force arises and acts on the head portion 2O*a*. As a result, the discharge reed valve 20 can be inhibited effectively from adhering on the retainer 21 through the lubricant contained in the refrigerant.

Thus, also in accordance with the discharge valve apparatus of the Second Preferred Embodiment, the volumetric efficiency deterioration, resulting from the retardation of the discharge reed valve 20 in the returning, can be inhibited effectively. In addition, even if a larger discharge pressure acts on the reed valve 20, the entire surface of the head portion 20*a* is deformed considerably so as to follow the curved surface portion 21*b* of the retainer 21, and the discharge reed valve 20 is adhered to the retainer 21 without forming the clearance "A," a much larger elastic recovery force arises and acts on the head portion 20*a* so that the discharge reed valve 20 can be promptly separated from the retainer 21.

Modified Versions of the First and the Second Preferred Embodiments

In the valve apparatuses of the First and the Second Preferred Embodiments, the curved surface portions 21*b* of the retainers 21 are described so that they have predetermined constant radii of curvature. However, the present invention is not limited thereto.

Figure 11:
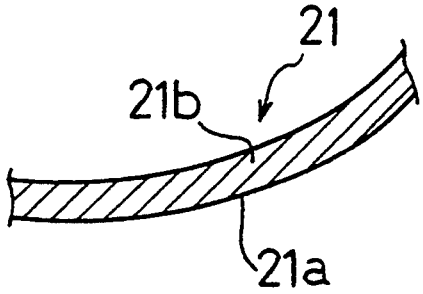
FIG. 11 is an enlarged schematic cross sectional view of a curved surface portion of an inclining surface of a retainer in a modified version of the discharge valve apparatuses of the First and the Second Preferred Embodiments.

For example, the curved surface portion 21*b* of the retainer 21 may have a continuously varying radius of curvature as schematically illustrated in FIG. 11.

Figure 12:
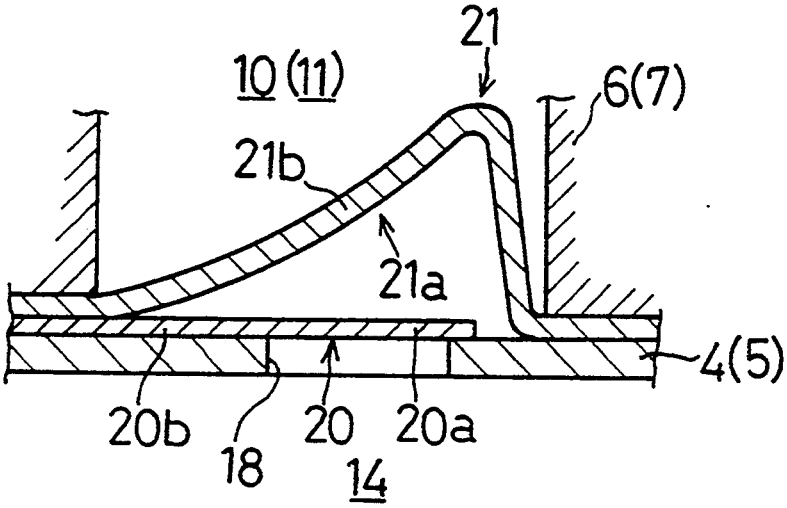
FIG. 12 is a fragmentary cross sectional view of another modified version of the discharge valve apparatuses of the First and the Second Preferred Embodiments.

Further, the retainer 21 may be free from the flat surface portion 21*c*, but it may include the curved surface portion 21*b* entirely as illustrated in FIG. 12.

Figure 13:
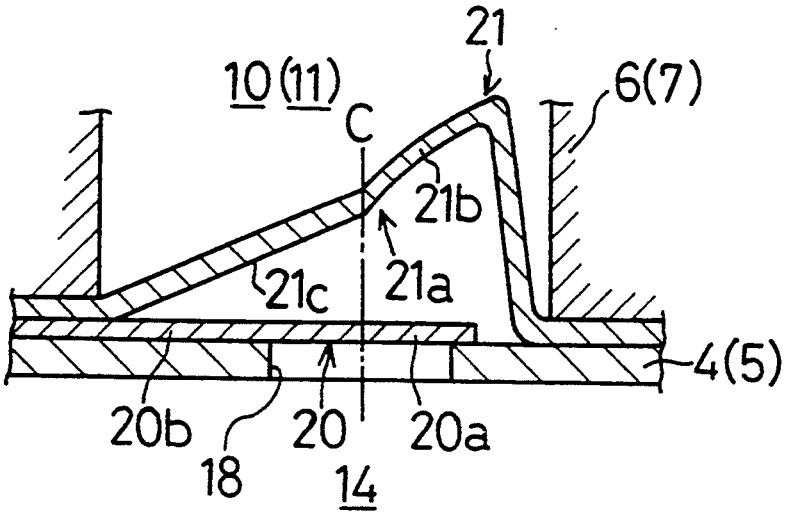
FIG. 13 is a fragmentary cross sectional view of a still another modified version of the discharge valve apparatuses of the First and the Second Preferred Embodiments.

Furthermore, the curved surface portion 21*b* of the retainer 21 may have a concave cross section whose opening is opened to the discharge reed valve 20 side as illustrated in FIG. 13. In other words, the curved surface portions 21*b* are protruded toward the discharge reed valves 20*a* and the front valve plates 4 in the discharge valve apparatuses of the First and the Second Preferred Embodiments, but the curved surface 21*b* may be protruded toward the discharge chamber 10 in this modified version of the discharge valve apparatuses of the First and the Second Preferred Embodiments.

Third Preferred Embodiment

Figure 7:
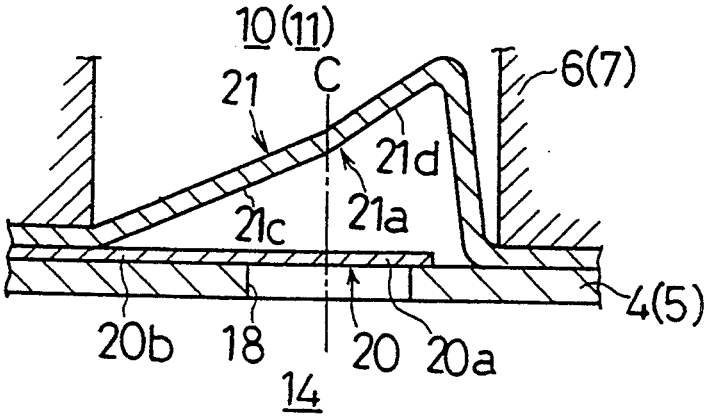
FIG. 7 is a fragmentary cross sectional view of a discharge valve apparatus of a Third Preferred Embodiment according to the present invention.
Figure 8:
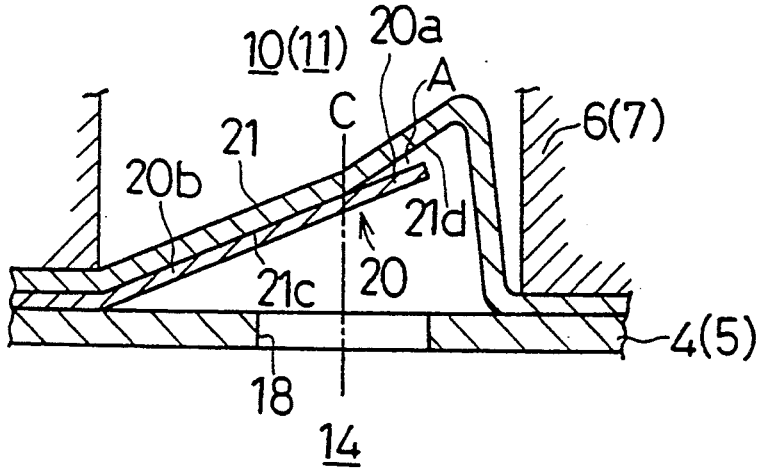
FIG. 8 is a fragmentary cross sectional view for illustrating an operation of the discharge valve apparatus of the Third Preferred Embodiment in which a discharge reed valve is brought into contact with a retainer.

As illustrated in FIGS. 7 and 8, the discharge valve apparatus of the Third Preferred Embodiment comprises a retainer 21 including an inclining surface 21*a*. The inclining surface 21*a* includes two flat surface portions having different inclinations with each other. Namely, the inclining surface 21*a* varies the inclination at the position where it intersects the center line of a discharge port 18. Specifically speaking, the inclining surface 21 includes a flat surface 21*c* which faces a portion of a discharge reed valve 20 extending from the substantial center of a head portion 20*a* thereof to a neck portion 20*b* thereof, and a flat surface portion 21*d* which faces a portion of a discharge reed valve 20 extending from the substantial center of the head portion 20*a* to a free end thereof and which has an inclination larger than the flat surface portion 21*c* does.

It is apparent that the discharge valve apparatus of the Third Preferred Embodiment operates and provides advantageous effects in a manner similar to those of the discharge valve apparatus of the Second Preferred Embodiment. Hence, the operations and the advantageous effects will not be described herein.

Fourth Preferred Embodiment

Figure 9:
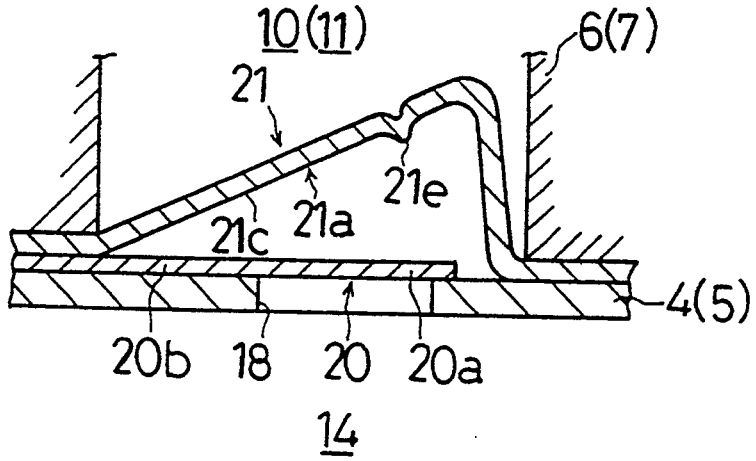
FIG. 9 is a fragmentary cross sectional view of a discharge valve apparatus of a Fourth Preferred Embodiment according to the present invention.
Figure 10:
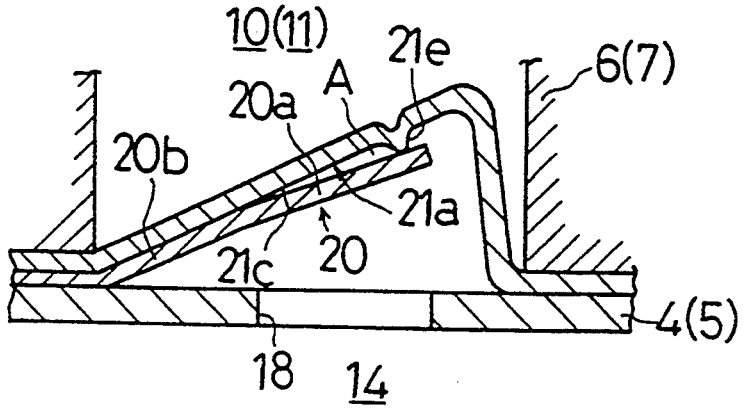
FIG. 10 is a fragmentary cross sectional view for illustrating an operation of the discharge valve apparatus of the Fourth Preferred Embodiment in which a discharge reed valve is brought into contact with a retainer.

As illustrated in FIGS. 9 and 10, the discharge valve apparatus of the Fourth Preferred Embodiment comprises a retainer 21 which includes an inclining surface 21*a* provided with a contact projection 21*e*. The contact projection 21*e* is disposed at a portion of the retainer 21 which faces a head portion 20*a* of a discharge reed valve 20, and it is formed so as to extend linearly in the width-wise direction (or depth-wise direction in FIG. 14) of the retainer 21. Other than the contact projection 21*e*, the inclining surface 21*a* includes a flat surface 21*c*.

In the discharge valve apparatus of the Fourth Preferred Embodiment, the contact projection 21*e* works to provide a clearance "A" between the head portion 20*a* of the discharge reed valve 20 and the retainer 21 as illustrated in FIG. 10, and the contacting area therebetween decreases accordingly. As a result, also in the discharge valve apparatus of the Fourth Preferred Embodiment, the discharge reed valve 20 is likely to come off the retainer 21.

Modified Versions of the Fourth Preferred Embodiment

Figure 14:
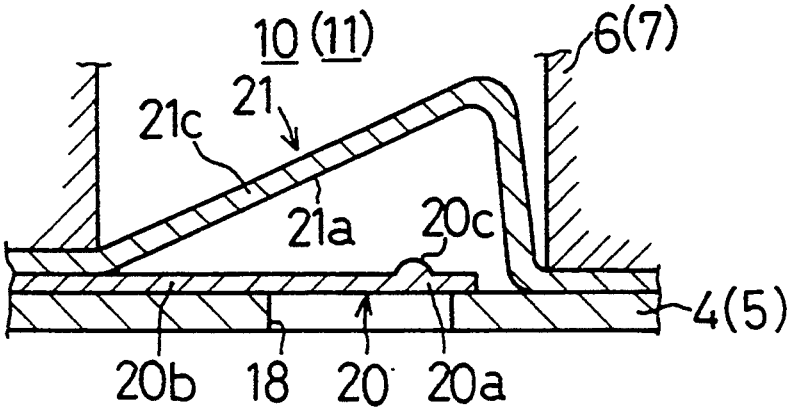
FIG. 14 is a fragmentary cross sectional view of a modified version of the discharge valve apparatus of the Fourth Preferred Embodiment.

As illustrated in FIG. 14, instead of the retainer 21 including the inclining surface 21*a* provided with the contact projection 21*e*, the discharge valve apparatus of the Fourth Preferred Embodiment may comprise a discharge reed valve 20 which includes a head portion 20*a* provided with a contact projection 20*c*. The contact projection 20*c* is disposed adjacent to a free end of the head portion 20*a* , and it is formed so as to extend linearly in parallel with the width-wise direction (or depth-wise direction in FIG. 14) of the retainer 21.

Figure 15:
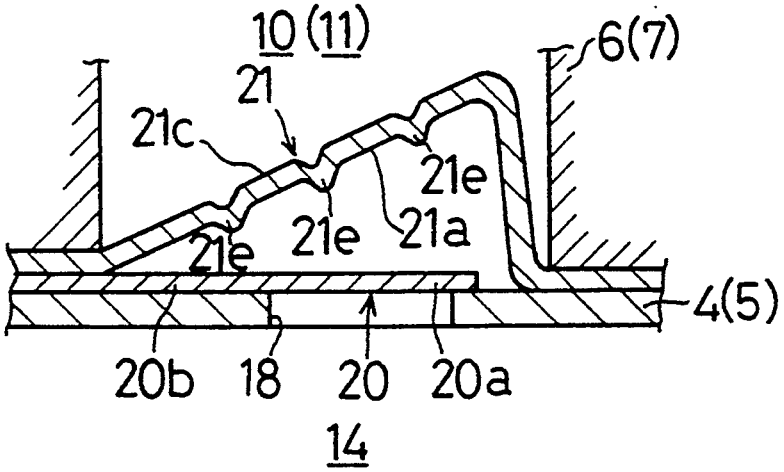
FIG. 15 is a fragmentary cross sectional view of another modified version of the discharge valve apparatus of the Fourth Preferred Embodiment.
Figure 16:
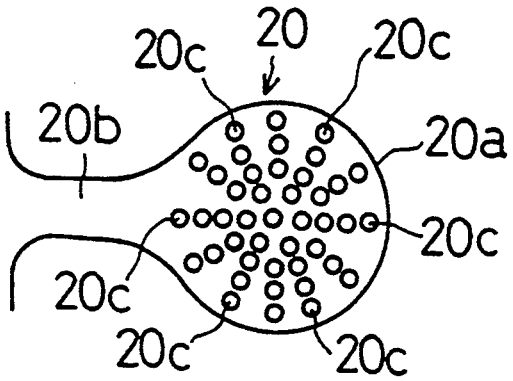
FIG. 16 is a plan view for illustrating a construction of a discharge reed valve in a still another modified version of the discharge valve apparatus of the Fourth Preferred Embodiment.
Figure 17:
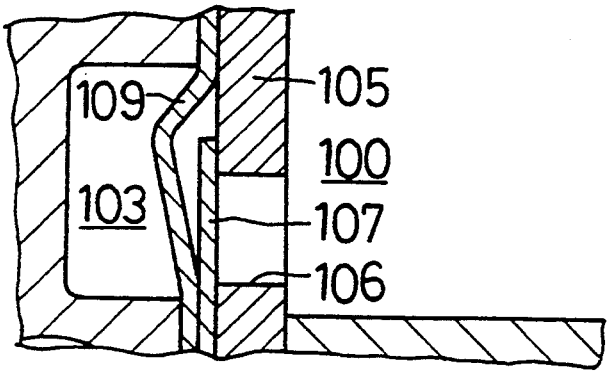
FIG.17 (PRIOR ART)
FIG. 17 is a fragmentary cross sectional view of the conventional reed valve type valve apparatus.

In addition, the contact projection 21*e* or 20*c* is not restricted in its shape, size and position. For instance, a plurality of minute projections 21*e* may be provided on the entire surface of the retainer 21 as illustrated in FIG. 15, or a plurality of minute projections 20*c* may be provided on the entire surface of the head portion 20*a* of the discharge reed valve 20 as illustrated in FIG. 16.

It is apparent that these modified versions of the discharge valve apparatus of the Fourth Preferred Embodiment operate and provide advantageous effects in a manner similar to those of the discharge valve apparatus of the Fourth Preferred Embodiment. Hence, the operations and the advantageous effects will not be described herein.

Having now fully described the present invention, it will be apparent to one of ordinary skill in the art that many changes and modifications can be made thereto without departing from the spirit or scope of the present invention as set forth herein including the appended claims.

What is claimed is:

1. A discharge valve apparatus for a compressor, comprising:

a valve plate with a port;

a reed valve fixed on said valve plate, adapted for swingably opening and closing said port elastically, and having a substantially disk-shaped head portion at one end of a constricted neck portion; and a retainer fixed on said valve plate, and having an inclined surface adapted for regulating the degree of opening of said reed valve, said inclined surface having a curved surface portion and a flat surface portion, the curved surface portion and the flat surface portion being joined at a location where the retainer is contacted by said head portion of said reed valve when the reed valve fully opens said port.

2. The discharge valve apparatus for a compressor according to claim 1, wherein said curved surface portion faces a portion of said reed valve extending from substantially the center of said head portion to said neck portion, and said flat surface portion faces a portion of said reed valve extending from substantially the center of said head portion to a free end thereof, thereby forming a clearance between said curved surface portion of said retainer and the portion of said reed valve extending from substantially the center of said head portion to said neck portion.

3. The discharge valve apparatus for a compressor according to claim 1, wherein said curved surface portion faces a portion of said reed valve extending from about the center of said head portion to a free end thereof, and said flat surface portion faces a portion of said reed valve extending from about the center of said head portion to said neck portion, whereby a clearance is formed between said curved surface portion of said retainer and the portion of said reed valve extending from about the center of said head portion to said free end.

4. The discharge valve apparatus for a compressor according to claim 1, wherein said curved surface portion has a radius of curvature which varies continuously.

5. The discharge valve apparatus for a compressor according to claim 1, wherein said curved surface portion has a concave cross section with the concavity facing said reed valve.

* * * * *

UNITED STATES PATENT AND TRADEMARK OFFICE

CERTIFICATE OF CORRECTION

PATENT NO. : 5,379,799

DATED : January 10, 1995

INVENTOR(S) : K. Kawai et al

It is certified that error appears in the above-indentified patent and that said Letters Patent is hereby corrected as shown below:

Column 1, line 25 change "lead" to --reed--.

Column 2, line 2, change "lead" to --reed--; line 17 change "lead" to --reed--; line 19, change "lead" to --reed--.

Signed and Sealed this

Twenty-third Day of May, 1995

*Attest:*

Bruce Lehman

BRUCE LEHMAN

*Attesting Officer*

*Commissioner of Patents and Trademarks*